US006874813B2

(12) United States Patent
Perotto et al.

(10) Patent No.: US 6,874,813 B2
(45) Date of Patent: Apr. 5, 2005

(54) HYBRID GAS GENERATOR FOR A SIDE AIRBAG APPLIED TO MOTOR VEHICLE SAFETY

(75) Inventors: Christian Perotto, Ergue Gaberic (FR); Franck Lebaudy, Loperhet (FR); Bernard Martin, Ballancourt (FR); François A Rigault, Quimper (FR)

(73) Assignee: Livbag SNC, Paris (FR)

( * ) Notice: Subject to any disclaimer, the term of this patent is extended or adjusted under 35 U.S.C. 154(b) by 0 days.

(21) Appl. No.: 10/208,746

(22) Filed: Aug. 1, 2002

(65) Prior Publication Data

US 2003/0047924 A1 Mar. 13, 2003

(30) Foreign Application Priority Data

Sep. 12, 2001 (FR) ..... 01 11800

(51) Int. Cl.[7] ..... B60R 21/26
(52) U.S. Cl. ..... 280/737; 280/741
(58) Field of Search ..... 280/741, 737, 280/736, 742, 740; 102/530, 531

(56) References Cited

U.S. PATENT DOCUMENTS

| | | | | | |
|---|---|---|---|---|---|
| 3,711,115 | A | * | 1/1973 | Lohr | 280/736 |
| 5,649,720 | A | * | 7/1997 | Rink et al. | 280/737 |
| 5,794,973 | A | * | 8/1998 | O'Loughlin et al. | 280/737 |
| 5,890,735 | A | * | 4/1999 | Smith | 280/737 |
| 5,967,550 | A | | 10/1999 | Shirk et al. | |
| 6,010,153 | A | * | 1/2000 | Halas et al. | 280/737 |
| 6,019,389 | A | * | 2/2000 | Burgi et al. | 280/736 |
| 6,095,556 | A | * | 8/2000 | Bailey et al. | 280/737 |
| 6,237,950 | B1 | * | 5/2001 | Cook et al. | 280/736 |
| 6,289,820 | B1 | * | 9/2001 | Anacker et al. | 102/530 |
| 6,412,811 | B1 | * | 7/2002 | Campbell et al. | 280/730.2 |
| 6,499,764 | B2 | * | 12/2002 | Anacker et al. | 280/737 |
| 6,572,143 | B2 | * | 6/2003 | Yamato et al. | 280/741 |
| 6,601,872 | B2 | * | 8/2003 | Zimbrich et al. | 280/737 |
| 2001/0026064 | A1 | * | 10/2001 | Bergmann et al. | 280/737 |

FOREIGN PATENT DOCUMENTS

| | | |
|---|---|---|
| DE | 42 17 969 A1 | 12/1993 |
| DE | 200 19 665 U1 | 2/2001 |
| FR | 2 210 438 A | 7/1974 |
| GB | 2 316 475 A | 2/1998 |
| WO | WO 94/01307 | 1/1994 |

* cited by examiner

*Primary Examiner*—Ruth Ilan
(74) *Attorney, Agent, or Firm*—Oliff & Berridge, PLC

(57) ABSTRACT

The present invention relates to a hybrid gas generator (1), used for motor vehicle safety to inflate an airbag, comprising a body (2) containing an ignition device (16) and a reservoir (3) connected to the body and containing a pressurized gas (31), together with initially closed-off discharge orifices (10). The body possesses a first pyrotechnic charge (14) capable of generating a quantity of gas which, coupled to the volume of gas (31) contained in the reservoir, allows the airbag to be inflated in a time period of less than 50 milliseconds, and a second pyrotechnic charge (13) capable of generating, after combustion of the first pyrotechnic charge, a quantity of gas sufficient to keep the airbag inflated for a time period of several seconds.

11 Claims, 2 Drawing Sheets

HYBRID GAS GENERATOR FOR A SIDE AIRBAG APPLIED TO MOTOR VEHICLE SAFETY

BACKGROUND OF THE INVENTION

1. Field of Invention

The present invention relates to the field of motor vehicle safety and relates more particularly to a hybrid gas generator used to inflate an airbag.

2. Description of Related Art

In recent years, new generators, called adaptive generators, have appeared so as to limit the risk of body accidents brought about by deployment of the airbag. To do this, various generators, coupled to suitable detection systems, allow the flow rate and/or the volume of gas to be modulated according to certain parameters, such as for example the morphology and the position of the passenger, the ambient temperature, and the nature and intensity of the impact. The generators are in all cases designed to operate fully within a time period of about fifty milliseconds.

Very recently, motor vehicle manufacturers have desired to incorporate devices using inflatable airbags to protect occupants when the vehicle rolls over. To do this, the airbags must remain inflated for a time period of the order of some 10 seconds. U.S. Pat. No. 5,967,550 discloses a generator provided with two pyrotechnic charges, the first serving to inflate the airbag within the milliseconds that follow the accident and the second allowing the airbag to remain inflated for some ten seconds. However, the geometry of this generator differs from the generators usually employed and therefore cannot be integrated into a vehicle in the places currently predefined by motor vehicle manufacturers. Patent application GB 2 316 475 discloses a generator fulfilling the same functions, using two separate gas reserves. However, this generator is relatively complex to produce since the two gas reserves are separated from each other by a plug which must be able, on the one hand, to guarantee sealing between the two reserves for a period of fifteen years and, on the other hand, to suitably fragment when the pressure starts to drop in the first gas reserve. Finally, patent application DE 20019665 discloses a generator provided with a pyrotechnic charge for rapidly inflating the airbag and with at least two separate fluids which act thereafter to keep the airbag inflated for several seconds.

SUMMARY OF THE INVENTION

A person skilled in the art is therefore always seeking a generator offering both operating configurations mentioned above and allowing, on the one hand, the abovementioned problems to be solved and, on the other hand, the manufacturing costs to be reduced.

The subject of the present invention relates to a hybrid gas generator, used for motor vehicle safety to inflate an airbag, comprising, on the one hand, a body containing an ignition device and, on the other hand, a reservoir connected to the body and containing a pressurized gas, together with initially closed-off discharge orifices, characterized in that the body possesses:

i) a first pyrotechnic charge capable of generating a quantity of gas which, coupled to the volume of gas contained in the reservoir, allows the airbag to be inflated in a time period of less than 50 milliseconds, ii) a second pyrotechnic charge capable of generating, after combustion of the first pyrotechnic charge, a quantity of gas sufficient to keep the airbag inflated for a time period of several seconds.

Advantageously, the reservoir is of elongate cylindrical shape. The generator may in this way be used to inflate a side airbag. The body and the reservoir may either each be produced in a separate cylindrical element, or both produced in the same one-piece tube. In the second case, a perforated piece forming a nozzle is placed at the junction between the body and the reservoir. Moreover, the reservoir has one end closed off by means of a metal piece having at least one axial gas exit channel. This consequently permits the use of a single gas diffuser mounted on the said closed-off end of the reservoir and makes it much easier to fit the airbag taking into account the absence of a diffuser along the generator.

Preferably, the first pyrotechnic charge is produced in the form of loose cubes, and the second pyrotechnic charge is produced in the form of a cylindrical block provided with a central channel capable of containing the first pyrotechnic charge. Nevertheless, the first pyrotechnic charge may be generalized to any type of small objects housed loosely.

BRIEF DESCRIPTION OF THE DRAWINGS

FIG. 1 shows a generator 1 according to the invention that comprises a body 2 and a reservoir 3 which are each produced in a separate cylindrical element. The reservoir 3 has a curved first end 4 which is attached by soldering to one of the ends 5 of the body 2 so as to create a central passage 20 of narrow diameter located at the junction between the reservoir 3 and the body 2 and acting as a nozzle. This passage is initially closed off by a frangible membrane (not shown). The reservoir is also provided with a sidewall 6 and with a second end closed by a discoid metal piece 7 which is attached in the sidewall 6 by soldering. This metal piece 7 is provided, on the one hand, with a channel 8 initially closed off by a frangible membrane (not shown) and, on the other hand, with an orifice for filling with pressurized gas 31 and sealed off by a plug 30. This pressurized gas 31 may, for example, be completely or partly a mixture of helium, argon, oxygen and nitrous oxide. A diffuser 9 provided with axial discharge orifices 10 is attached by crimping onto the discoid metal piece 7.

Figure 1:
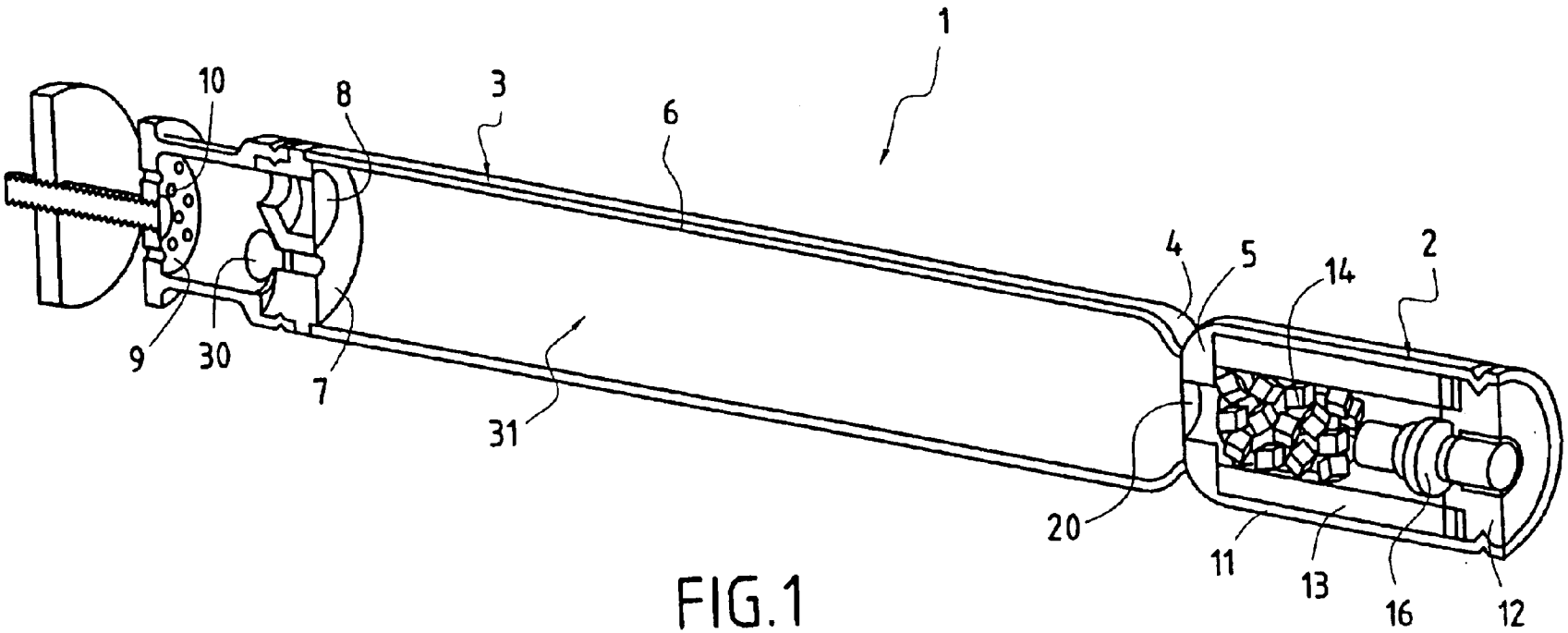
FIG. 1 is a partial perspective view of a hybrid pyrotechnic gas generator according to an embodiment of the invention.

The body 2 has a sidewall 11 and a second end via which the various elements contained in the body 2 are incorporated before the said end is closed off by a closure ring 12. More specifically, a pyrotechnic charge in the form of a cylindrical block 13 is firstly slipped into the body 2 and has an external surface in contact with the internal sidewall 11. This cylindrical block 13 is placed in abutment against that end of the body 2 which is attached by soldering to the first end 4 of the reservoir 3. Another pyrotechnic charge, in the form of loose cubes 14, is subsequently housed in the central channel of the cylindrical block 13. Finally, the closure ring 12, which is made in the form of a discoid metal piece into which an electropyrotechnic igniter 16 is inserted, is attached by crimping in the second end of the body 2. The cubes 14 consist of a composite propellant having a silicon-based binder and an oxidizing charge based on ammonium perchlorate and sodium nitrate. The cylindrical block 13 consists of a composite propellant having a binder based on polyurethane or polybutadiene and an oxidizing charge based, for example, on ammonium perchlorate.

In the event of an impact requiring an airbag to be inflated to protect the occupant, the generator 1 operates in the following manner. The electropyrotechnic igniter 16 initiates the combustion of the cubes 14 which generate, in a few milliseconds, a large amount of gas forcing the frangible membrane located at the junction between the body 2 and the reservoir 3 to fracture. This results in an increase in pressure in the reservoir 3 which forces the frangible membrane closing off the channel 8 to fragment. Finally, the gases are discharged via the axial discharge orifices 10 and inflate the airbag within a time period possibly ranging from 10 milliseconds to 50 milliseconds according to choice.

At the same time as this, the electropyrotechnic igniter 16 and the combustion of the cubes 14 also initiate the combustion of the cylindrical block 13 which is capable of generating an amount of gas sufficient to keep the airbag inflated for some 10 seconds. As previously, the gases generated by the cylindrical block 13 pass through the nozzle, then the gas exit channel 8 and finally escape via the discharge orifices 10.

Figure 2:
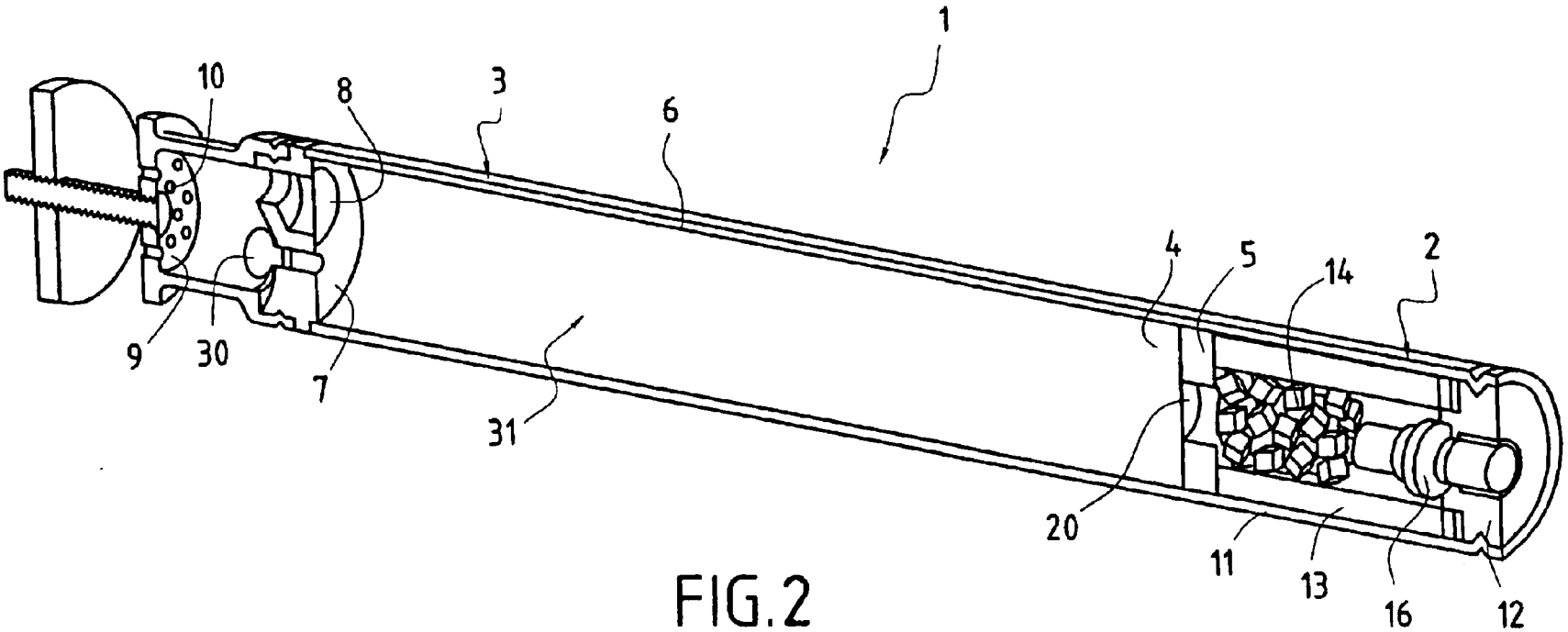
FIG. 2 is a partial perspective view of a hybrid pyrotechnic gas generator according to another embodiment of the invention.

FIG. 2 shows a generator 1 according to the invention that comprises a body 2 and a reservoir 3 which together form a one-piece tube.

What is claimed is:

1. Hybrid gas generator used for motor vehicle safety to inflate an airbag, comprising a body containing an ignition device, and a reservoir having an elongated shape connected to the body and containing pressurized gas, together with initially closed-off discharge orifices, said body possessing:

i) a first pyrotechnic charge capable of generating a quantity of gas which, coupled to the volume of gas contained in the reservoir, allows the airbag to be inflated in a time period of less than 50 milliseconds, and ii) a second pyrotechnic charge capable of generating a quantity of gas sufficient to keep the airbag inflated for a time period of several seconds, wherein:

a nozzle at the junction between a first end of said reservoir and said body, creates a central passage which is initially closed off by a frangible membrane, the gases generated within the body by both the first and the second pyrotechnic charges can pass through said central passage, after fracture of said frangible membrane, the first pyrotechnic charge can fracture the frangible membrane and, with the pressurized gas contained in the reservoir, open the discharge orifices, such that the pressurized gas in the reservoir and the gas generated by the first pyrotechnic charge can escape out of the reservoir at a second end of the reservoir and be discharged via the discharge orifices, in order to inflate the airbag in a time period of less than 50 milliseconds, and the gas generated by the second pyrotechnic charge can escape out of the reservoir at the second end of the reservoir and be discharged via the discharae orifices in order to keep the airbag inflated for a time period of several seconds.

2. Generator according to claim 1, characterized in that the reservoir is of elongate cylindrical shape.

3. Generator according to claim 2, characterized in that the body and the reservoir are each separate cylindrical elements.

4. Generator according to claim 2, characterized in that the body and the reservoir together form a one-piece tube.

5. Generator according to claim 1, characterized in that the second end of the reservoir is closed off by a metal piece having at least one gas exit channel oriented in the longitudinal direction of the elongated reservoir, wherein the pressurized gas in the reservoir and the gases generated by the pyrotechnic charges can escape out of the reservoir through said at least one gas exit channel to be discharged via said discharge orifices.

6. Generator according to claim 1, characterized in that a gas diffuser is mounted on the second end of the reservoir.

7. Generator according to claim 1, characterized in that the first pyrotechnic charge is produced in the form of loose cubes.

8. Generator according to claim 7, characterized in that the second pyrotechnic charge is produced in the form of a cylindrical block provided with a central channel containing the loose cubes which constitute the first pyrotechnic charge.

9. Generator according to claim 1, characterized in that the second pyrotechnic charge is produced in the form of a cylindrical block provided with a central channel containing the first pyrotechnic charge.

10. Generator according to claim 1, characterized in that the pressurized gas housed in the reservoir comprises at least one gas selected from the group consisting of helium, argon, oxygen, and nitrous oxide.

11. Generator according to claim 1, characterized in that the discharge orifices are initially closed-off by a metal piece containing a frangible membrane located between the pressurized gas and the discharge orifices, and the discharge orifices are opened by the fracture of the frangible membrane in said metal piece.

* * * * *